US006912826B2

(12) United States Patent
Momich

(10) Patent No.: US 6,912,826 B2
(45) Date of Patent: Jul. 5, 2005

(54) CARRIER LOADING CARTONER

(75) Inventor: Zoran Momich, 76 Bellechase Cir., Schaumburg, IL (US) 60173-6572

(73) Assignee: Zoran Momich, Schaumburg, IL (US)

( * ) Notice: Subject to any disclaimer, the term of this patent is extended or adjusted under 35 U.S.C. 154(b) by 0 days.

(21) Appl. No.: 10/265,926

(22) Filed: Oct. 7, 2002

(65) Prior Publication Data

US 2004/0065057 A1 Apr. 8, 2004

(51) Int. Cl.[7] ..... B65B 3/04

(52) U.S. Cl. ..... 53/252; 53/260; 53/241; 53/428

(58) Field of Search ..... 53/252, 578, 579, 53/251, 260, 255, 208, 473, 428, 525, 241, 248, 249, 235

(56) References Cited

U.S. PATENT DOCUMENTS

| | | | | | |
|---|---|---|---|---|---|
| 3,112,777 | A | * | 12/1963 | Lohse | 141/80 |
| 3,369,339 | A | * | 2/1968 | Speiser | 53/475 |
| 3,608,701 | A | | 9/1971 | Dieter | |
| 3,656,271 | A | * | 4/1972 | O'Shea et al. | 53/429 |
| 3,906,705 | A | | 9/1975 | Back et al. | |
| 4,048,784 | A | * | 9/1977 | Toby | 53/77 |
| 4,203,274 | A | * | 5/1980 | Warkentin et al. | 53/537 |
| 4,211,054 | A | | 7/1980 | Sramek | |
| 4,314,785 | A | * | 2/1982 | LaFleur et al. | 414/790.3 |
| 4,330,252 | A | * | 5/1982 | Bullock et al. | 425/412 |
| 4,600,351 | A | * | 7/1986 | Nelson | 119/846 |
| 4,782,644 | A | * | 11/1988 | Haarer et al. | 53/282 |
| 4,804,550 | A | * | 2/1989 | Bardsley et al. | 426/397 |
| 4,817,779 | A | | 4/1989 | Beck et al. | |
| 4,879,862 | A | * | 11/1989 | Nolte et al. | 53/438 |
| 4,982,556 | A | * | 1/1991 | Tisma | 53/506 |
| 5,022,216 | A | * | 6/1991 | Muckenfuhs et al. | 53/438 |
| 5,095,960 | A | * | 3/1992 | Grundler et al. | 141/114 |
| 5,159,796 | A | * | 11/1992 | Tas | 53/245 |
| 5,170,610 | A | * | 12/1992 | Tisma | 53/447 |
| 5,175,976 | A | * | 1/1993 | Petry et al. | 53/252 |
| 5,233,814 | A | * | 8/1993 | Bergerioux et al. | 53/536 |
| 5,388,389 | A | | 2/1995 | Tisma | |
| 5,457,941 | A | * | 10/1995 | Long et al. | 53/460 |
| 5,657,610 | A | * | 8/1997 | Dietrich et al. | 53/139.5 |
| 5,787,680 | A | * | 8/1998 | Tisma et al. | 53/244 |
| 6,434,912 | B1 | * | 8/2002 | Walz | 53/247 |
| 6,729,103 | B1 | * | 5/2004 | Hartness et al. | 53/247 |

FOREIGN PATENT DOCUMENTS

| | | |
|---|---|---|
| EP | 0 765 810 A1 | 4/1997 |
| IT | 296889 | 2/1972 |
| WO | WO 01/62601 | 8/2001 |

* cited by examiner

*Primary Examiner*—John Paradiso
(74) *Attorney, Agent, or Firm*—Pauley Petersen & Erickson

(57) ABSTRACT

A system and method of loading a product into a carton includes loading the product into a carrier and then extending the carrier into the carton. The product is then restrained within the carton as the carrier is removed from the carton. The carrier may include a static carrier having a fixed volume or a dynamic carrier having moveable sidewalls.

16 Claims, 9 Drawing Sheets

CARRIER LOADING CARTONER

BACKGROUND OF THE INVENTION

1. Field of the Invention

This invention relates to a cartoner having a carrier that extends product into a carton where the product is maintained as the carrier is withdrawn.

2. Description of Related Art

Cartoners are used in varied applications requiring the placement of a product or products, such as food, pharmaceuticals, beverages and other items, into cartons or boxes. Cartoners traditionally require: a carton chain to transport empty cartons for filling; a product chain for transporting product to the carton chain; and a barrel loader for pushing the product from the product chain to the empty cartons on the carton chain. Such systems therefore result in product that is out of the positive control of the equipment during transition from the product chain to the carton chain, i.e., as the product is pushed or swept into the carton by the barrel loader.

Product may become damaged, may cause line stoppages or may result in partially filled and/or overfilled cartons when outside of the positive control of the cartoner. In addition, such systems that permit pushing or sweeping of product into cartons may result in slower line speeds.

Traditional cartoners often include buckets having fixed sidewalls for transporting product. As a result, products that require settling and/or other conditioning, such as bags of grain, cereal, chips or similar products, often require additional equipment such as collation systems or stacking systems to line-up, condition and distribute the product into the buckets of the product chain. Absent such additional equipment, such products are prone to damage and causing line stoppages during the cartoning process.

SUMMARY OF THE INVENTION

Accordingly, it is one object of this invention to provide a cartoner that inserts product into a carton under the positive control of the equipment.

It is another object of this invention to provide a cartoner that ensures that product is accurately and completely placed within a carton.

It is another object of this invention to provide a cartoner that is capable of conditioning product prior to insertion in a carton.

It is another object of this invention to provide a cartoner that combines the functions of a product chain and a barrel loader.

It is another object of this invention to provide a cartoner that avoids product damage, line stoppages and unfilled, misfilled and/or overfilled cartons.

These and other objects of this invention are addressed by a cartoner that includes a carrier conveyor and a carton chain. The carrier conveyor positively controls the product as the product is inserted into each carton of the carton chain. The carrier conveyor includes a plurality of carriers, either static or dynamic, that each accommodate at least one product. The cartoner operates by first loading a product into the carrier. The carrier is then extended into the carton and the product is restrained within the carton. Finally, the carrier is withdrawn from the carton. As a result of this preferred method of operation, product is not lost, damaged or misaligned during the cartoning process.

A mechanism for inserting and withdrawing each carrier into each carton is positioned in operative association with the carrier conveyor. The mechanism preferably comprises a cammed arrangement that enables the carrier to extend into each carton and subsequently withdraw from the respective carton. Prior to withdrawal of the carrier from the carton, the product is obstructed or otherwise maintained within the carton. A stripper is used for maintaining the product in the carton as the carrier is withdrawn and may comprise a finger or other component that extends into contact with an edge of the carrier, carton and/or product as the carrier is withdrawn from the carton.

The carrier may comprise a static carrier having generally fixed and rigid sidewalls or, alternatively may comprise a dynamic carrier having moveable and/or reciprocating sidewalls. The dynamic carrier capable of linear reciprocation permits the conditioning or settling of product prior to cartoning.

The cartoner described herein may include synchronized components and/or line shafting that operates mechanically, electronically or a combination of both using gears, belts, servomechanism and other similar components known to those having ordinary skill in the art.

BRIEF DESCRIPTION OF THE DRAWINGS

These and other objects and features of this invention will be better understood from the following descriptions taken in conjunction with the drawings wherein.

DETAILED DESCRIPTION OF THE PREFERRED EMBODIMENTS

Figure 1:
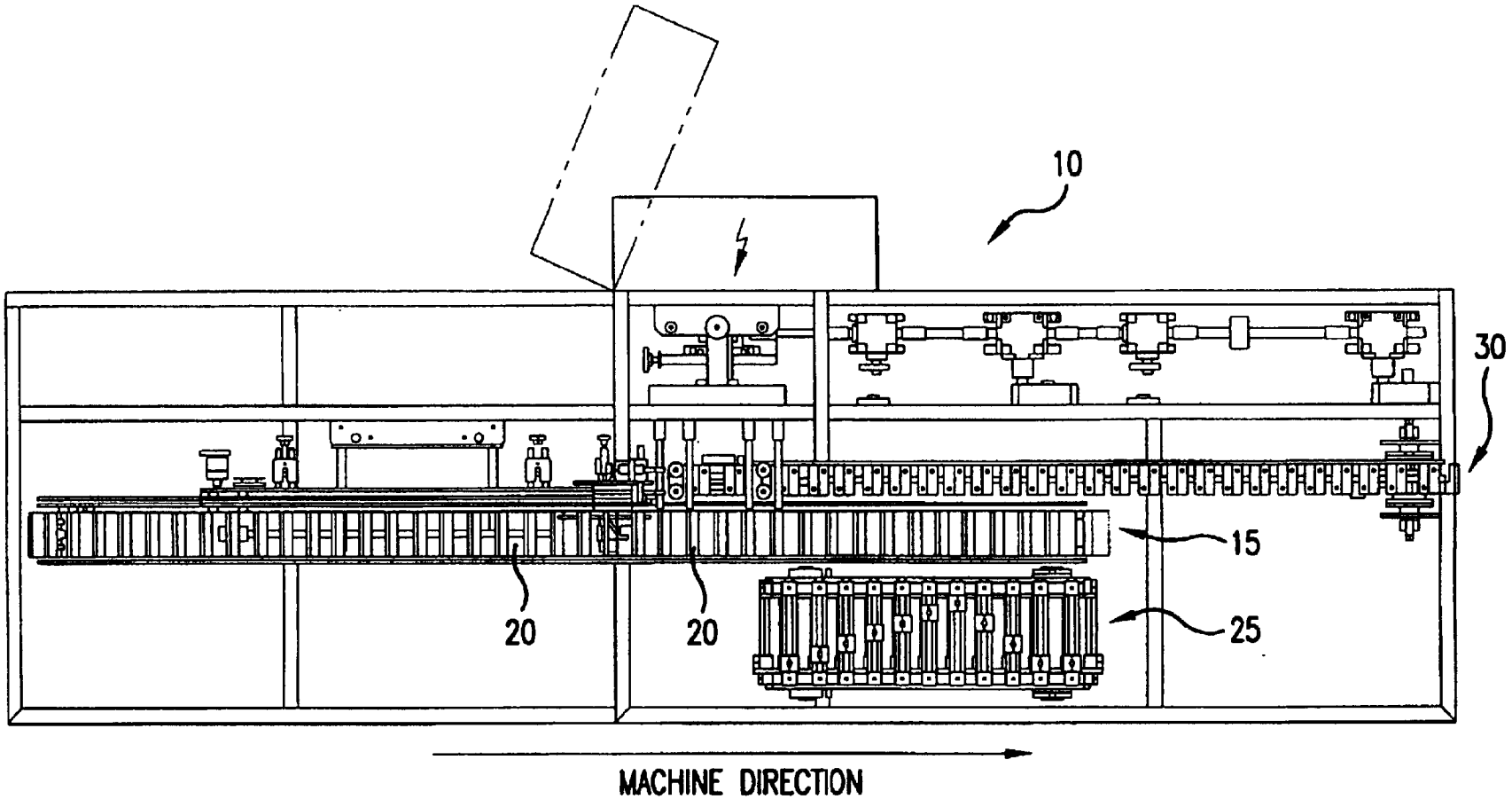
FIG. 1 PRIOR ART
FIG. 1 is a plan view of a prior art cartoner.

FIG. 1 shows a prior art cartoner 10 having product chain 15, barrel loader 25 and carton chain 30. As described above, product is loaded into buckets 20 of product chain 15 and conveyed into synchronization with carton chain 30. Product chain 15 and carton chain 30 both move in a machine direction of cartoner 10, which generally matches the path of product through cartoner 10. Barrel loader 25 then urges the product, in a transverse direction generally perpendicular to the product path, from each bucket 20 into a corresponding carton in carton chain 30. The filled cartons are then conveyed from the cartoner 10 for closure, palletizing, shipping, etc.

Figure 2:
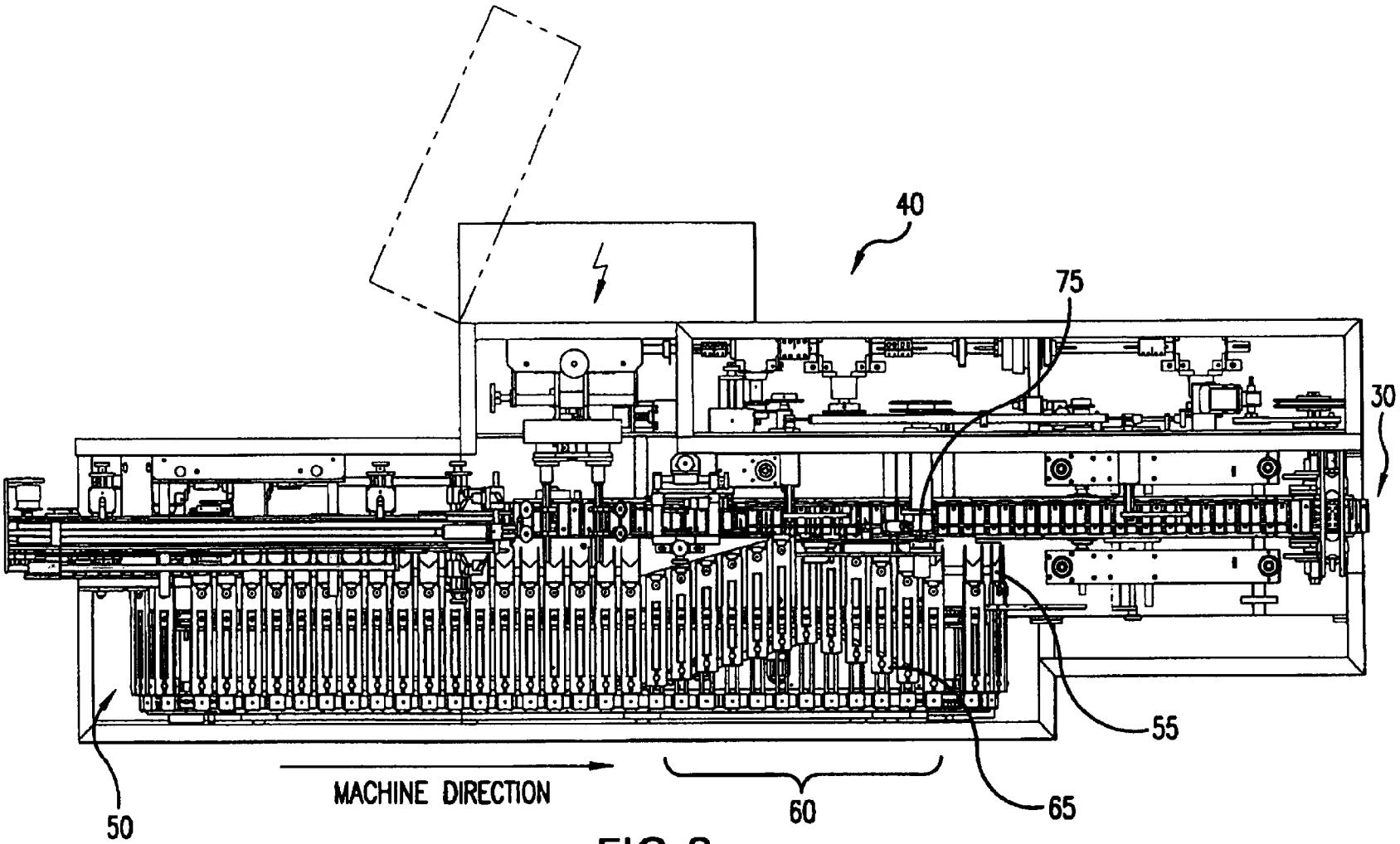
FIG. 2 is a plan view of a cartoner according to one preferred embodiment of this invention.

FIG. 2 shows cartoner 40 according to one preferred embodiment of this invention. Cartoner 40 preferably includes carton chain 30, similar to those used in connection with the prior art cartoner 10, and carrier conveyor 50. Carrier conveyor 50, as described in more detail below, positively controls the product as the product is inserted in the transverse direction into each carton of carton chain 30. Specifically, each carrier 55 maintains positive control of the product in the machine direction as the product is inserted into each carton.

A system for loading product into a carton according to this invention preferably includes carrier conveyor 50 having a plurality of carriers 55, each carrier 55 accommodating at least one product. The term "product" as used herein may be one or more items that are to be contained within a carton including food, beverages, pharmaceuticals, consumer goods, bulk goods, packages, papers and any other product that may be boxed or cartoned according to the method and apparatus described herein. Carriers 55 may comprise dynamic carriers and/or static carriers, which are each described in more detail below. The terms "carrier" and "bucket" are used interchangeably and refer to the containment device in the carrier conveyor that transfers product from the carrier conveyor to the carton chain and/or into the carton.

Products may be presented and transferred to carrier conveyor 50 in a number of ways known to those having ordinary skill in the art. As described above, products may include bottles, bags, trays and any other product requiring cartoning. As such, equipment for presenting and transferring products to carton chain 30 need only be capable of placing, dropping, sliding or otherwise presenting product to each carrier 55 along carrier conveyor 50. As described in more detail below, carrier 55 may present a large target to minimize the necessary accuracy and therefore increase the potential speed of the presentment/transfer means and thus cartoner 40.

According to a preferred method of this invention, cartoner 40 operates by first loading a product into carrier 55; carrier 55 is then extended into the carton; the product is then restrained in the carton whereupon carrier 55 is withdrawn from the carton. As a result of this preferred method of operation, product is not lost, damaged or misaligned during the cartoning process.

Carton chain 30 transporting a plurality of empty cartons is preferably positioned adjacent carrier conveyor 50 as shown in FIG. 2. Carton chain 30 preferably includes a conveyor having a plurality of divisions or trays, each division receiving an empty and erect carton. The divisions in the carton chain 30 are preferably synchronized with carriers 55 in carrier conveyor 50. As described in more detail below, such synchronization may either be mechanical, i.e., gearing, belts, etc., electrical, i.e., servomechanisms, etc., or a combination of both.

According to a preferred embodiment of this invention, mechanism 60 for inserting and withdrawing each carrier 55 into each carton is positioned in operative association with carrier conveyor 50. Mechanism 60 may comprise a cammed arrangement such as described below or any equivalent arrangement known to those having ordinary skill in the art that enables carrier 55 to extend into each carton and subsequently withdraw from the respective carton.

Figure 5:
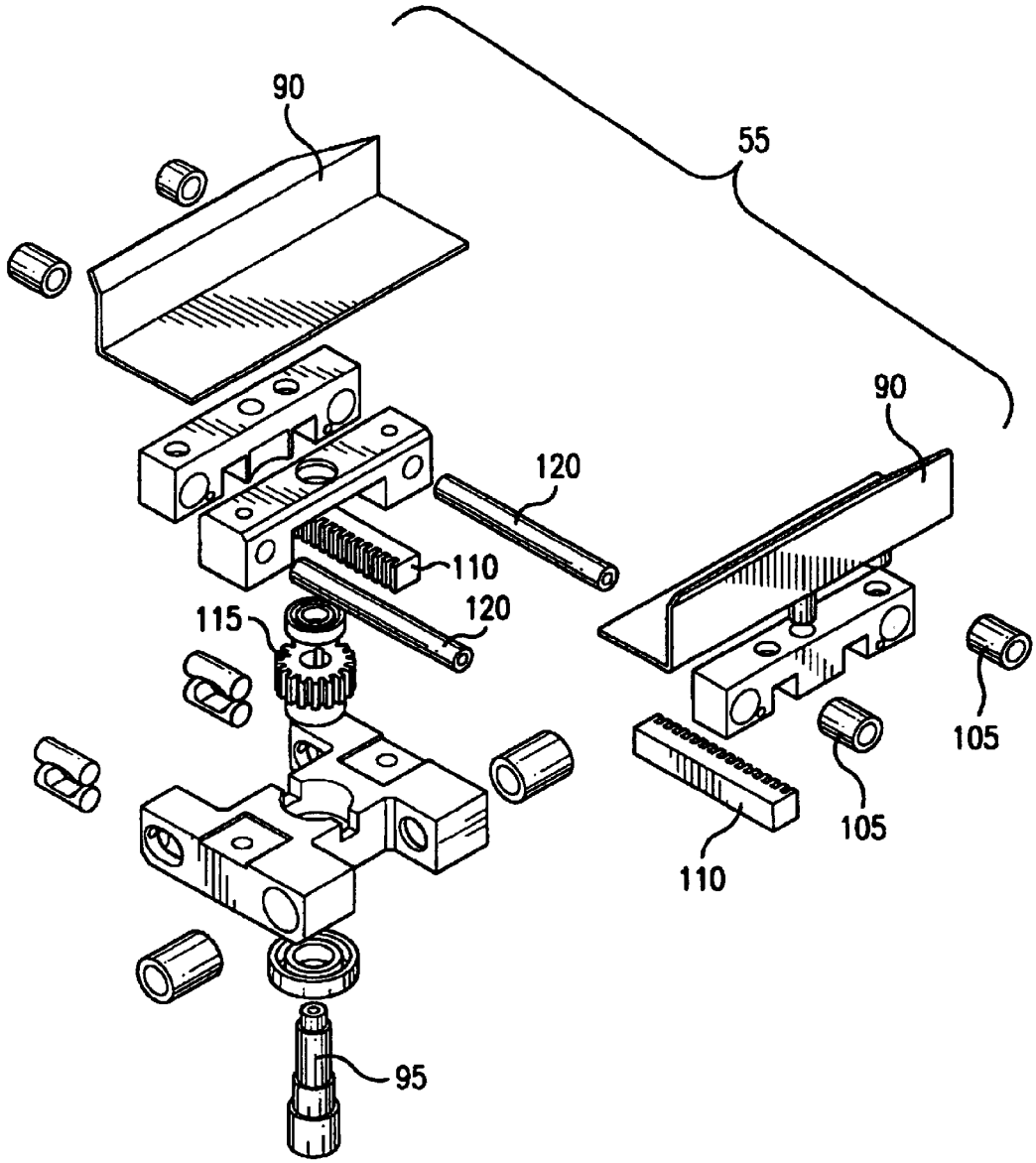
FIG. 5 is an exploded perspective view of a carrier according to one preferred embodiment of this invention.
Figure 6:
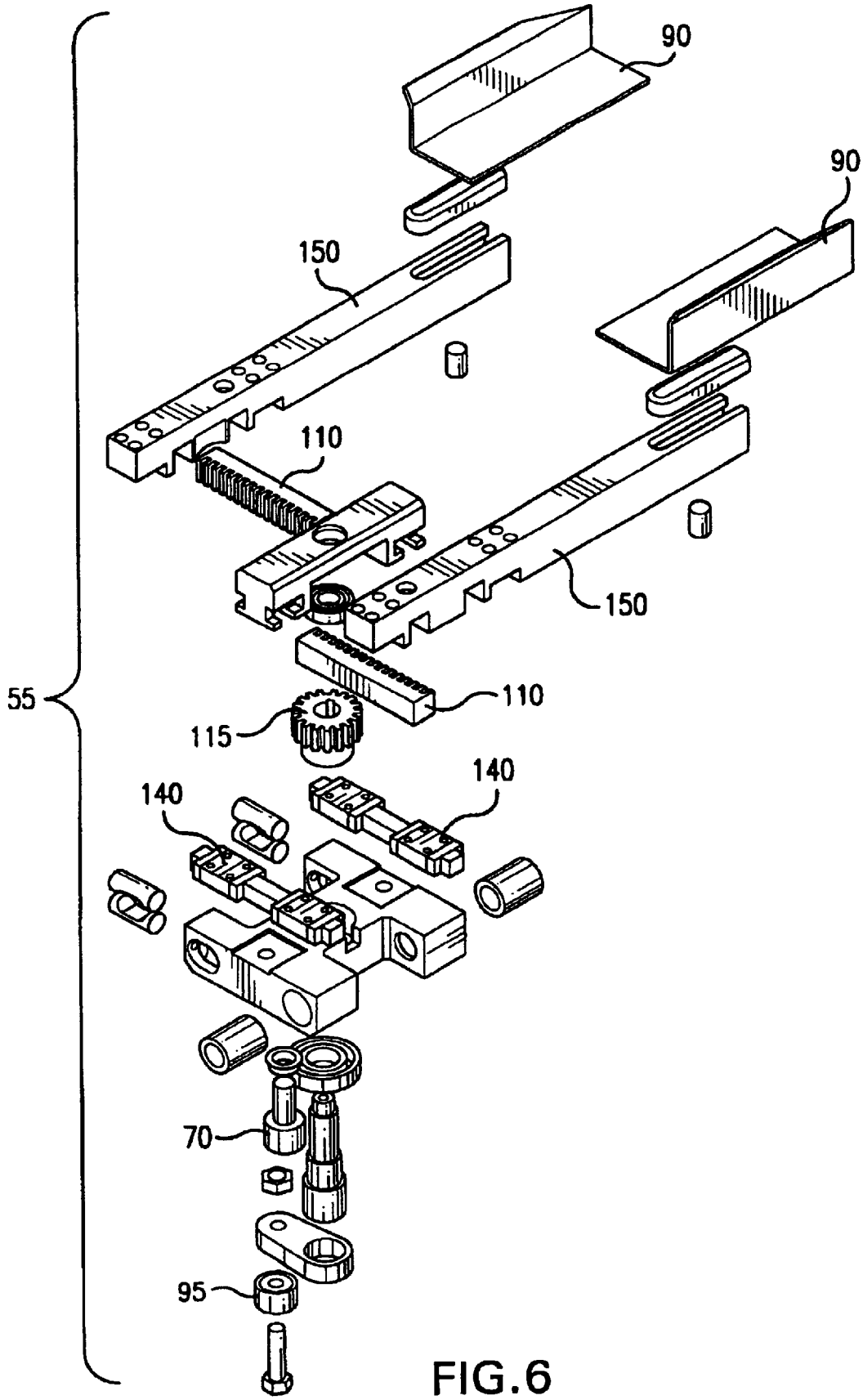
FIG. 6 is an exploded perspective view of a carrier according to another preferred embodiment of this invention.

Mechanism 60 which initiates and controls carrier 55 insertion into the carton may include one or more carrier cam followers 70 attached with respect to each carrier 55. Carrier cam followers 70 may comprise one or more wheels, nubs or other suitable follower that traverses carrier cam 65 positioned with respect to carrier conveyor 50, such as shown in FIGS. 5 and 6. As shown in FIG. 2, carrier cam 65 may be a groove positioned below carrier conveyor 50, a set of tracks positioned above carrier conveyor 50 or any similar arrangement that permits a desired flow of carriers 55 across carrier conveyor 50. Accordingly, as shown in FIG. 2, as carrier cam follower 70 proceeds through carrier cam 65, carrier 55 extends toward carton chain 30 until carrier 55 is positioned within empty and erect carton. Product within carrier 55 is then obstructed, restrained or otherwise maintained within the carton as the carrier cam 65 directs the carrier 55 back away from carton chain 30 resulting in the carrier 55 being withdrawn from the carton.

Figure 11:
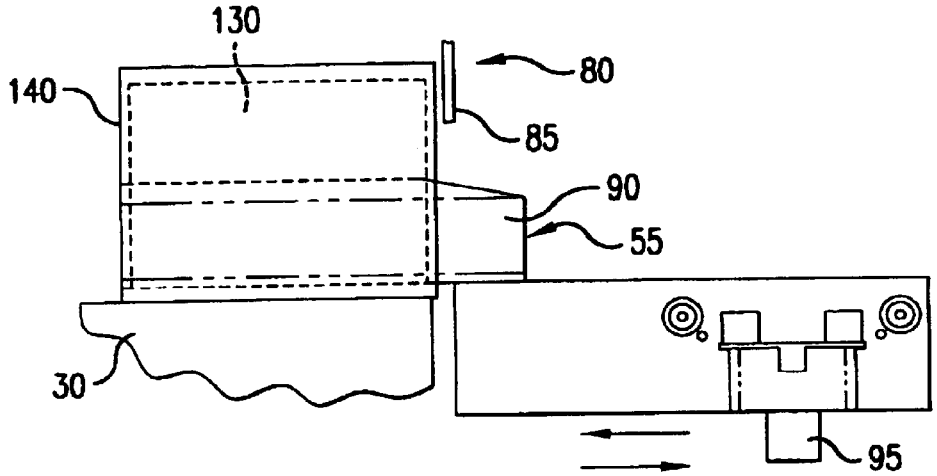
FIG. 11 is a side view of the carrier shown in FIG. 10 in a fully extended position within a carton.
Figure 12:
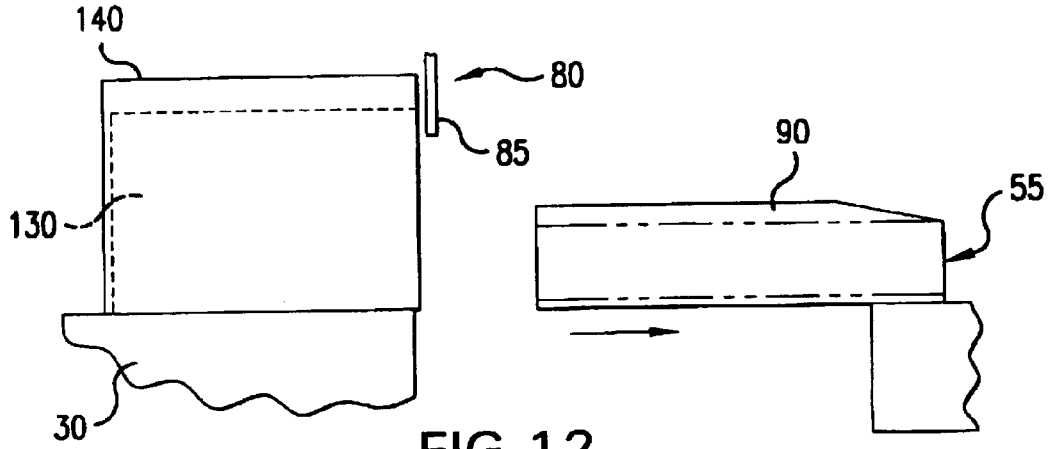
FIG. 12 is a side view of the carrier shown in FIG. 10 in a retracted position following withdrawal from the carton.
Figure 13:
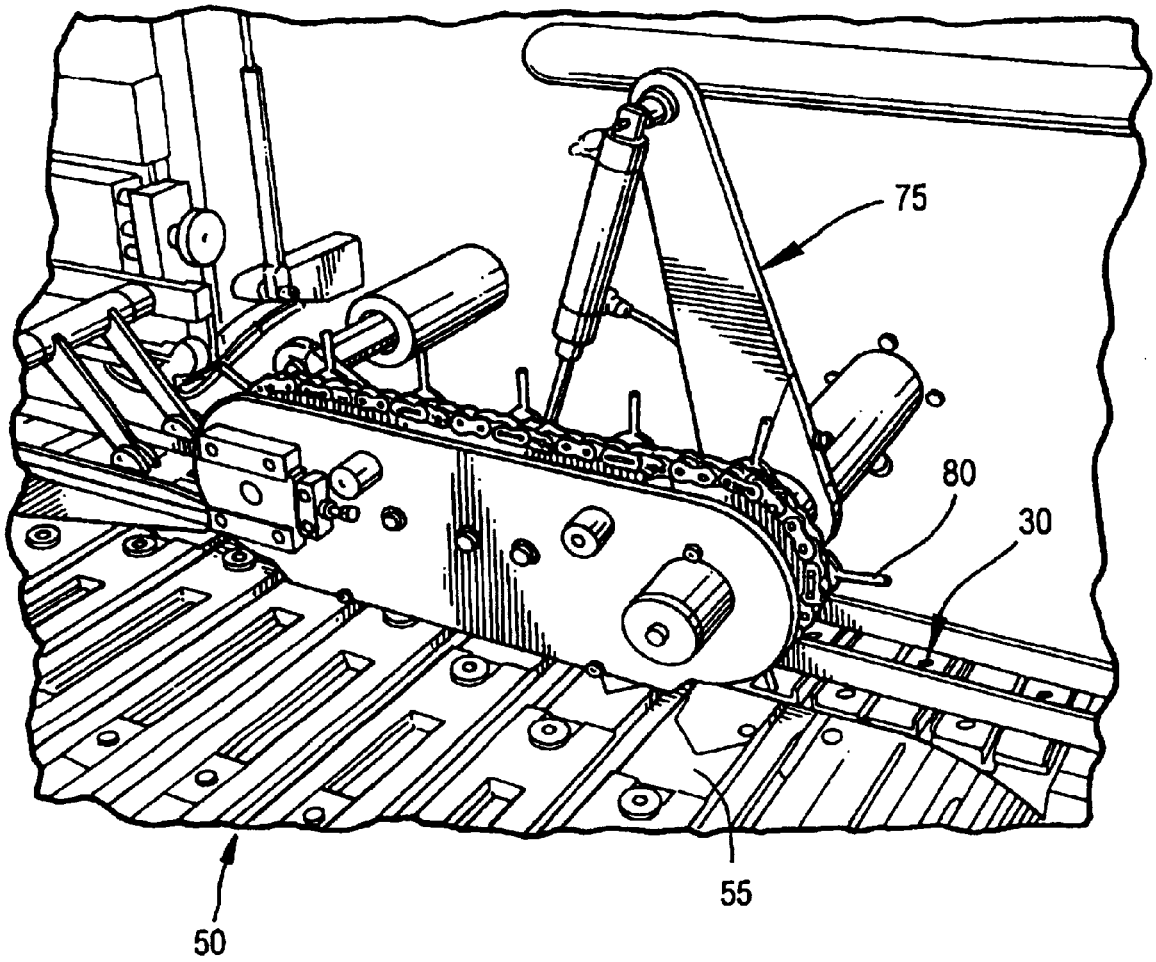
FIG. 13 is a perspective view of a carrier chain and stripper according to one preferred embodiment of this invention.

As described, the product is obstructed or otherwise maintained within the carton as carrier 55 is withdrawn from the carton. According to one preferred embodiment of this invention, stripper 80, shown in FIG. 13, is used for maintaining the product in the carton as carrier 55 is withdrawn. Stripper 80 may comprise finger 85, as shown in FIGS. 11 and 12, that extends towards an outer edge of carrier 55, an outer edge of the product and/or an outer edge of the carton, as carrier 55 is withdrawn from the carton. Stripper 80 may alternatively comprise a wiper, a roller or any other suitable arrangement for maintaining the product in the carton as the carrier 55 is withdrawn from under the product and out of the carton. FIG. 13 shows an embodiment of cartoner 40 wherein stripper 80 is configured on a stripper transport 75 such as shown in FIG. 13.

Static Carrier

Figure 3:
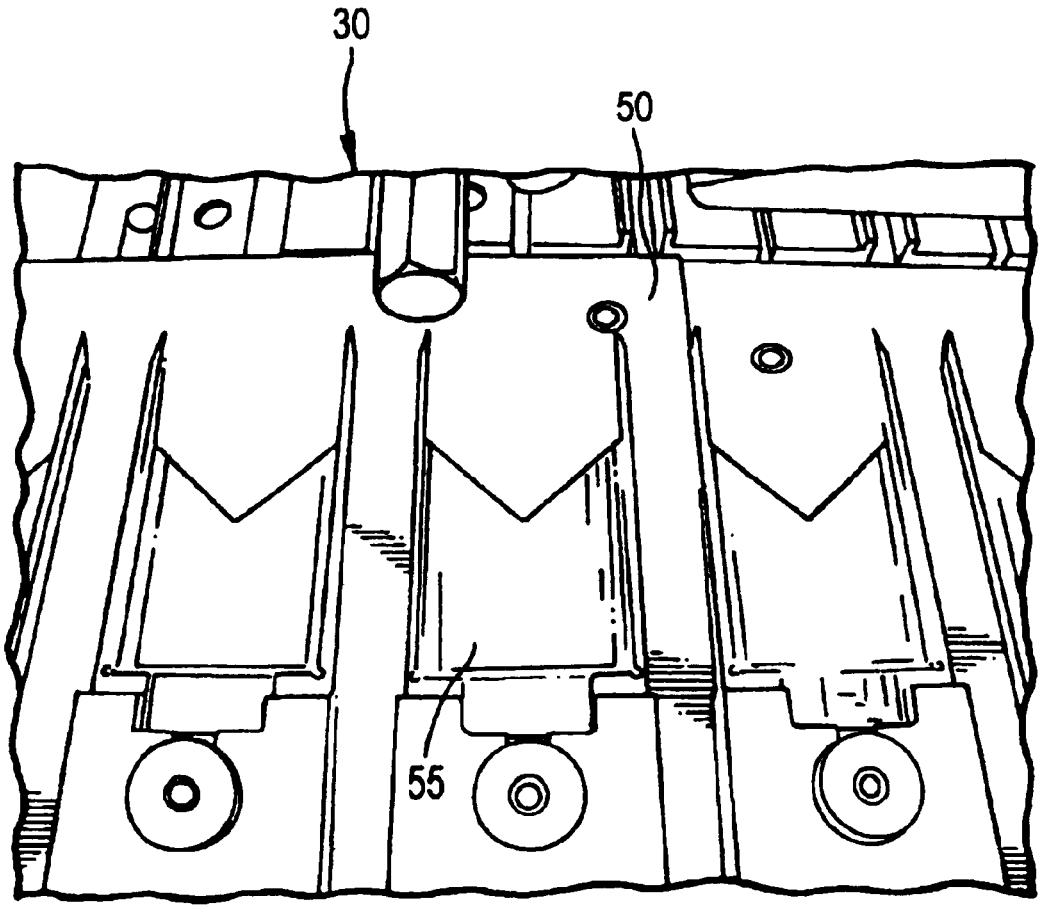
FIG. 3 is a top view of a carrier chain according to one preferred embodiment of this invention.

According to one preferred embodiment of this invention, carrier 55 comprises a static carrier such as shown in FIG. 3. Static carrier is preferably used for product having a generally rigid construction; for product that does not require conditioning; and/or for product that otherwise requires a fixed or static-walled carrier. Carrier 55 shown in FIG. 3, for example, may be used to transport blister packages of gum or pharmaceuticals. Preferably, carriers 55 are removable, replaceable and/or interchangeable along carrier conveyor 50 using fasteners, such as with knurled bolts as shown in FIG. 3, and/or toolless quick-release systems, such as a ball detente arrangement, known to those having ordinary skill in the art.

FIG. 13 shows an arrangement of carrier conveyor 50 having static carriers that are urged toward carton chain 30 whereupon stripper 80 is synchronized to travel between carrier 55 and the carton (not shown) as carrier 55 is then withdrawn from the carton. The size, configuration and timing of stripper transport 75 may be adjusted either mechanically or electrically.

Dynamic Carrier

According to another preferred method of this invention for loading unconditioned product into a carton, as shown in FIGS. 4–9, carrier 55 comprises a dynamic carrier/bucket and includes sidewalls 90 capable of linear reciprocation. As sidewalls 90 of carrier 55 reciprocate, the product is conditioned and/or settled and carrier 55 is then extended into the carton. A restraint, such as stripper 80, is next extended between the product and an edge of carrier 55 outside of the product and carrier 55 is then removed from the carton.

Figure 4A:
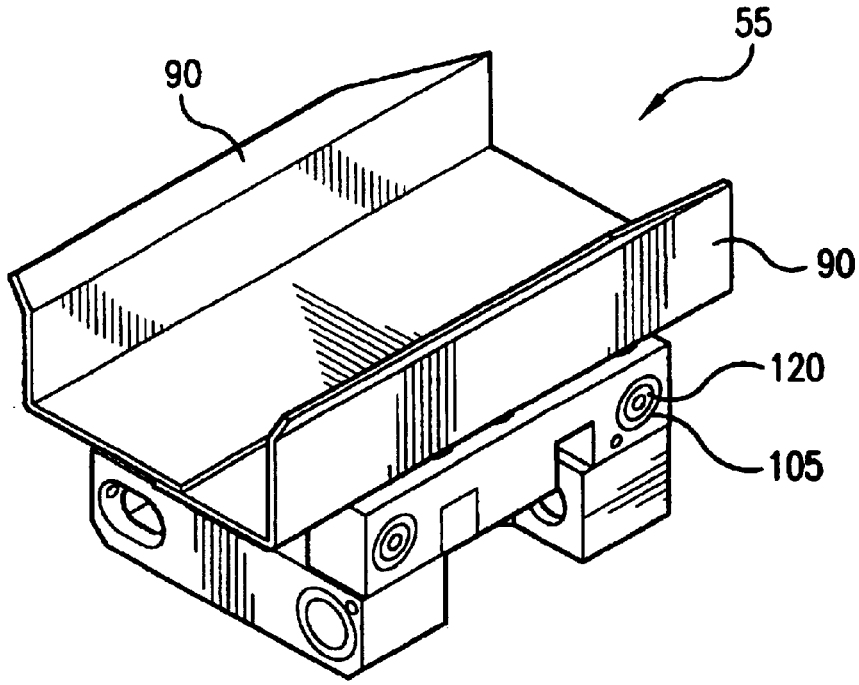
FIG. 4A is a perspective view of a carrier in a first linear position according to one preferred embodiment of this invention.
Figure 4B:
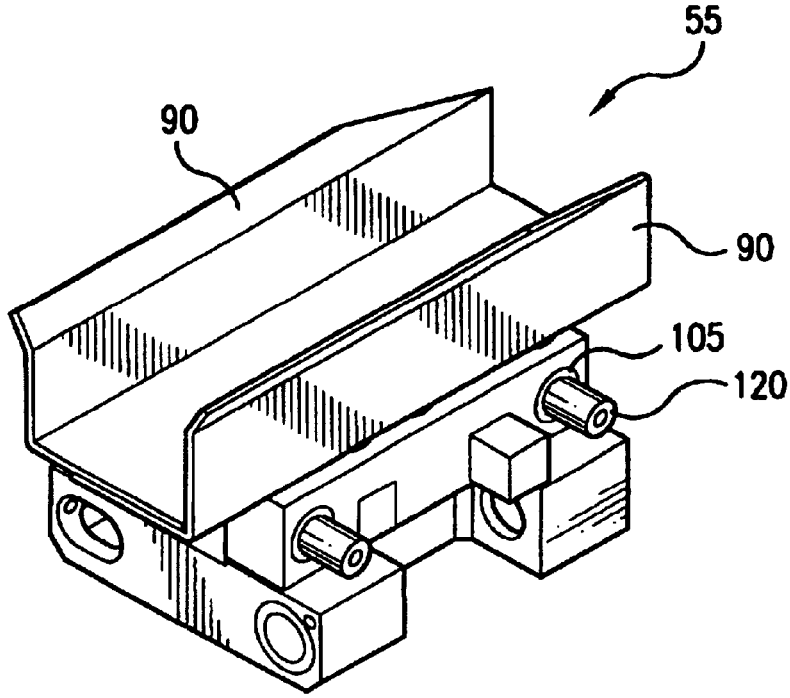
FIG. 4B is a perspective view of the carrier shown in FIG. 4A in a second linear position.

The opposing sidewalls 90 of carrier 55 are preferably moveable between a first linear position wherein the opposing sidewalls 90 are at a maximum distance apart, such as shown in FIG. 4A, and a second linear position wherein the opposing sidewalls 90 are at a minimum distance apart, such as shown in FIG. 4B. Preferably, sidewalls 90 are moveable to and/or through any other position between the first linear position and the second linear position. FIGS. 5 and 6 show one preferred embodiment of carrier 55 wherein sidewalls 90 are L-shaped to include a bottom and a respective sidewall. Alternatively, sidewalls 90 may be configured in any preferred manner known to those having ordinary skill in the art. In addition, FIG. 6 shows one embodiment having cantilevered arms 150 to provide for insertion of carrier 55 into the carton.

Figure 7:
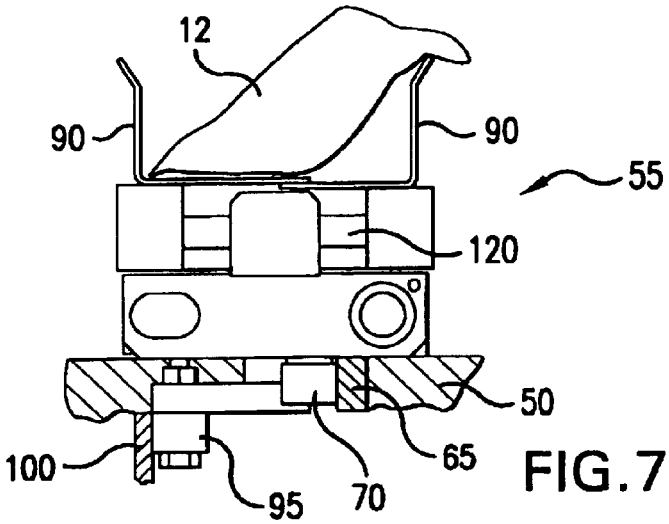
FIG. 7 is a front view of the carrier in the first linear position and product according to one preferred embodiment of this invention.
Figure 8:
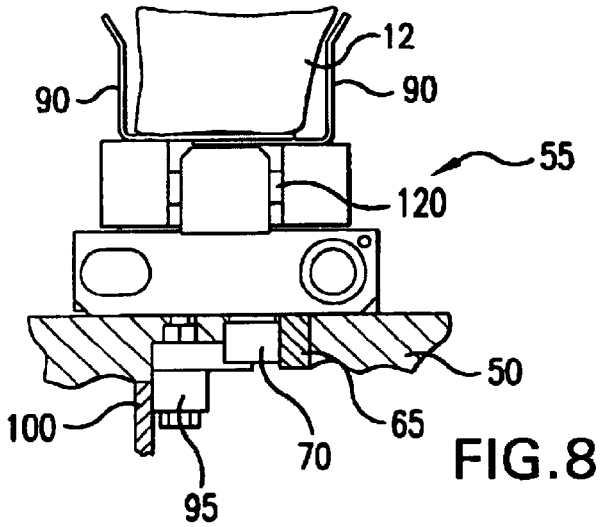
FIG. 8 is a front view of the carrier shown in FIG. 7 in the second linear position and product.
Figure 9:
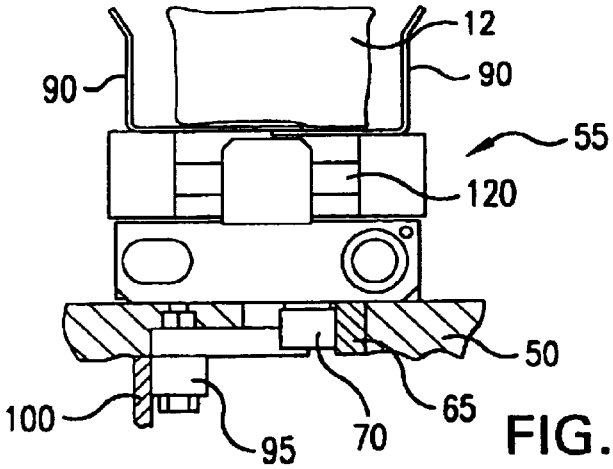
FIG. 9 is a front view of the carrier shown in FIG. 7 in the first linear position and product, following conditioning of the product.

FIGS. 7–9 demonstrate how a product, such as bag 12, may be conditioned by reciprocating sidewalls 90 between the first linear position and the second linear position. FIG. 7 shows bag 12 in carrier 55 when sidewalls 90 are in the first linear position (i.e., a maximum distance apart). During many packaging/cartoning operations, the product may be dropped or placed into carrier 55 such that it is off-center, splayed or otherwise out of an optimum position for cartoning. FIG. 8 shows carrier 55 with sidewalls 90 moved into the second linear position (i.e., a minimum distance apart) wherein sides of bag 12 are compressed thereby placing bag 12 into a conditioned and/or optimum position for cartoning. FIG. 9 shows the return of carrier 55 to the first linear position whereupon the process may repeat to reciprocate sidewalls 90 to condition bag 12 or, alternatively, bag 12 may be moved to carton chain 30. Bags 12 containing liquid or granular contents may be especially suited to a dynamic carrier that provides a wide target for loading carrier 55 but permits a narrow carrier width for loading carton quickly and efficiently.

In addition, to conditioning and/or settling the product, the dynamic carrier may additionally result in a more efficient loading process for multi-product applications. For instance, sidewalls 90 may be positioned at the first linear position to accommodate a first product, then drawn closer together to accommodate a second product, then drawn closer together, such as to the second linear position, to accommodate a third product. This process groups adjacent carriers 55 in a tight formation immediately prior to loading cartons and yet facilitates insertion of larger products at the beginning of the cartoning cycle. In addition, a product may be inserted into carrier 55 at the first linear position and sidewalls 90 may be gradually drawn together to condition and/or settle the product in a manner that minimizes damage and/or trauma to the product.

According to a preferred embodiment of this invention shown in FIGS. 4A, 4B and 5, carrier 55 may include a rack and pinion arrangement to permit reciprocation of sidewalls 90. As shown in FIG. 5, carrier 55 may expand and contract using rack gears 110 and pinion 115 which permit sliding across one or more slides 120. A rack and pinion system facilitates a wide range of linear motion and therefore product sizes and configurations. For this reason, the rack and pinion system having linear kinematics does not have the limitations of systems having rotational kinematics which may be limited in travel to the 90° rotation of the rotational disc. In addition, the rack and pinion system according to this preferred embodiment of the invention is subject to unlimited motion depending upon the configuration of sidewall cam 100.

Slides 120 in carrier 55 may operate through bushing 105 or, alternatively a bearing such as a THK slide 140, such as shown in FIG. 6. Use of a THK slide 140 results in a smoother, more linear and more controlled movement across an entire width of carrier 55 which is particularly helpful in applications requiring a long carrier and/or a heavy product. FIG. 6 shows carrier 55 having a cantilevered design that would benefit from such a bearing.

According to one preferred embodiment of this invention shown in FIGS. 4–6, carrier 55 includes a sidewall cam follower 95 attached with respect to each carrier 55. A sidewall cam 100, such as shown in FIGS. 7–9, is correspondingly positioned relative to carrier conveyor 50 whereupon the sidewall cam follower 95 slides relative to the sidewall cam 100 to actuate and/or reciprocate sidewalls 90 between the first linear position and the second linear position. As such cam 100 may be arranged to permit any desired movement of sidewalls 90, either rapid reciprocation across a wide distance or very little to no reciprocation across a very narrow distance.

As described above, the dynamic carrier embodiment of the present invention may be used in connection with mechanism 60, as shown in FIG. 2, for inserting carrier 55 into each carton of carton chain 30 and then withdrawing carrier 55 as product is restrained with the carton. As in the static carrier embodiment of this invention, stripper 80 is preferably used for maintaining the product in the carton as carrier 55 is withdrawn. Stripper 80 may comprise finger 85, as shown in FIGS. 10–13, that extends towards an outer edge of carrier 55 as carrier 55 is withdrawn from the carton.

Figure 10:
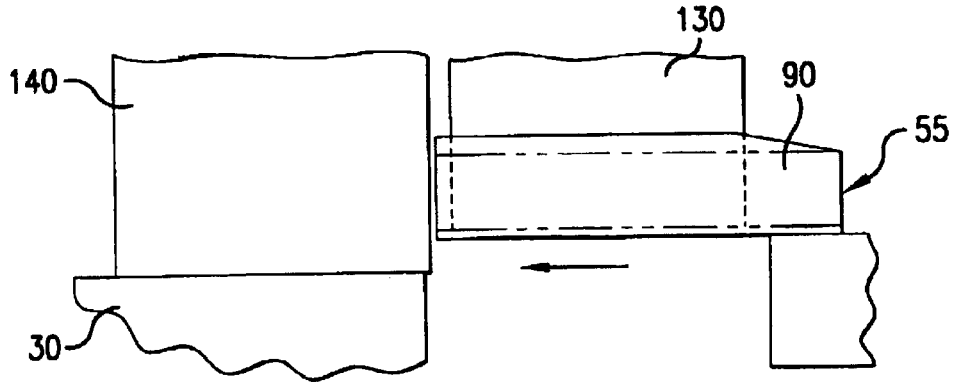
FIG. 10 is a side view of a carrier in a partially extended position according to one preferred embodiment of this invention.

FIGS. 10–13 show a schematic insertion of consumable 130 (the "product") into box 140 (the "carton"). FIG. 10 shows carrier 55 in a partially forward position relative to box 140. FIG. 11 shows carrier 55 in a fully forward position relative to box 140 wherein finger 85 is inserted at least partially across an open end of box 140 to maintain consumable 130 within box 140. FIG. 12 shows a retracted position of carrier 55 wherein consumable 130 is fully loaded within box 140.

Cartoner 40 as described herein may include synchronized components and/or line shafting that is executed either mechanically, electronically or a combination of both using gears, belts, servomechanism and other similar components known to those having ordinary skill in the art.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A method of loading product into a carton comprising:

loading the product into a carrier having opposing sidewalls, the carrier maintaining positive control of the product;

reciprocating the sidewalls of the carrier relative to each other prior to extending the carrier into the carton;

extending the carrier and the product together into the carton;

restraining the product in the carton; and removing the carrier from the product and the carton.

2. The method of claim 1 further comprising:

extending a stripper member into engagement with the carton to restrain the product in the carton.

3. The method of claim 1 further comprising:

sliding the carrier along a carrier cam to extend and remove the carrier into the carton.

4. The method of claim 1 wherein the sidewalls reciprocate linearly with a rack and pinion.

5. A method of loading product into a carton comprising:

loading the product into a carrier having opposing sidewalls;

reciprocating the sidewalls of the carrier relative to each other to condition the product;

closing the sidewalls of the carrier toward the product;

extending the carrier and the product into the carton;

extending a restraint between the product and an edge of the carrier; and removing the carrier from the product and the carton.

6. The method of claim 5 wherein the carrier travels under control of a sidewall cam to reciprocate the sidewall.

7. The method of claim 5 wherein a carrier cam controls motion of the carrier into and out of the carton.

8. The method of claim 5 further comprising the step of:

synchronizing movement of the carrier and the carton using a servomechanism.

9. A system for loading product into a carton comprising:

a carrier conveyor having a plurality of carriers, each carrier of the plurality of carriers accommodating and transporting at least one product between a pair of opposing sidewalls, wherein each carrier includes a pair of opposing sidewalls, the sidewalls reciprocable between a first linear position and a second linear position;

a carton chain transporting a plurality of cartons adjacent to the carrier conveyor;

a mechanism for inserting and withdrawing each carrier and the at least one product together into each carton of the plurality of cartons; and a stripper for maintaining the at least one product in the carton as the carrier is withdrawn from the carton.

10. The system of claim 9 wherein the mechanism is a carrier cam follower attached with respect to each carrier and a carrier cam positioned with respect to the carrier conveyor.

11. The system of claim 9 further comprising:

a sidewall cam follower attached with respect to each carrier; and a sidewall cam positioned relative to the carrier conveyor, the sidewall cam follower sliding relative to the sidewall cam to move the sidewalls between the first linear position and the second linear position.

12. The system of claim 9 wherein the stripper comprises a finger that extends into contact with an outer edge of the carton as the carrier is withdrawn from the carton.

13. A system for loading product into a carton comprising:

a carrier conveyor having a plurality of carriers, each carrier of the plurality of carriers accommodating at least one product between a pair of opposing sidewalls, the sidewalls moveable between a first linear position and a second linear position;

a sidewall cam follower attached with respect to each carrier; and a sidewall cam positioned relative to the carrier conveyor, the sidewall cam follower sliding relative to the sidewall cam to reciprocate the sidewalls between the first linear position and the second linear position resulting in settling the at least one product in the carrier.

14. The system of claim 13 further comprising:

a carton chain positioned adjacent the carrier conveyor, the carton chain transporting a plurality of cartons; and a mechanism for inserting and removing each carrier into each carton of the plurality of cartons.

15. The system of claim 14 further comprising:

a stripper for maintaining the at least one product in the carton as the carrier is removed.

16. The system of claim 13 further comprising:

a rack and pinion gear set for reciprocating the pair of sidewalls.

* * * * *